United States Patent [19]

Ristvedt et al.

[11] Patent Number: 5,022,889

[45] **Date of Patent: * Jun. 11, 1991**

[54] COIN SORTER

[76] Inventors: Victor G. Ristvedt, Rte. 8, Box 8904; Mark E. Ristvedt, 1000 Woodland Ct., both of Manchester, Tenn. 37355

[ * ] Notice: The portion of the term of this patent subsequent to Sep. 5, 2006 has been disclaimed.

[21] Appl. No.: 260,183

[22] Filed: Oct. 19, 1988

Related U.S. Application Data

[63] Continuation-in-part of Ser. No. 44,971, May 6, 1987, Pat. No. 4,863,414, which is a continuation-in-part of Ser. No. 877,205, Jun. 23, 1986, Pat. No. 4,681,128.

[51] Int. Cl.[5] ..... G07D 3/16

[52] U.S. Cl. ..... 453/6; 453/32

[58] Field of Search ..... 453/6, 10, 32

[56] References Cited

U.S. PATENT DOCUMENTS 4,086,928 5/1978 Ristvedt et al. ..... 453/6

4,098,280 7/1978 Ristvedt et al. ..... 453/10

4,444,212 4/1984 Ristvedt et al. ..... 453/10

4,564,036 1/1986 Ristvedt ..... 453/10

4,607,649 8/1986 Taipale et al. ..... 453/6

FOREIGN PATENT DOCUMENTS 0149906 7/1985 European Pat. Off. ..... 453/6

*Primary Examiner*—F. J. Bartuska

[57] ABSTRACT

A coin sorter in which a sorting head is positioned over a rotating pliable disc and wherein coins are sorted by the combination of an inwardly or outwardly extending tapered edge and a series of pins generally positioned in an outwardly extending line spaced from the tapered edge. The spacing between the line of pins and tapered edge changes with radial dimension, whereby coins of different diameter are urged over the tapered edge by pins at different positions. The coins are then captured between the head and pliable disc and rotated to exit positions which are unique for each coin about the outside of the sorting head.

10 Claims, 10 Drawing Sheets

PAD ROTATION
58
56
92(L-.035)
78(L-.088)
106(L-.035)
99(L-.025)
150(L-.048)

COIN SORTER

CROSS-REFERENCE OF RELATED APPLICATION

This invention is a continuation-in-part of application Ser. No. 07/044,971, filed May 6, 1987 now Pat. No. 4,863,414, which is a continuation-in-part of application Ser. No. 06/877,205, filed Jun. 23, 1986, now issued as U.S. Pat. No. 4,681,128, granted Jul. 21, 1987.

TECHNICAL FIELD

This invention relates generally to coin handling equipment and particularly to a high-speed coin sorter.

BACKGROUND OF THE INVENTION

U.S. Pat. Nos. 4,086,928 and 4,444,212 illustrate coin sorters which employ annular sorting heads positioned over and adjacent to a rotating resilient disc, and coins are introduced through a central opening in a sorting head. The undersides of the sorting heads of these patents are configured to effect a single layer-single file of coins utilizing a ramp, U.S. Pat. No. 4,086,928 utilizing the ramp for capturing coins so aligned for sorting and freeing others and directing them inward for recycling. U.S. Pat. No. 4,444,212 employs, in addition, a secondary recess to assure that coins not in a single layer and single file are separated. Following the ramp and return recess, or recesses, a single file-single layer of coins are rotated at a discrete and constant radial position, and coins of different diameter are then sorted as a function of the unique position of their inner edge. In U.S. Pat. No. 4,086,928, sorting and dispensing are accomplished by pressing the inner edge of a particular coin into the resilient surface at a discrete peripheral location by a plow device and for enabling the outer edge to freely rise and be hurled over a peripheral barrier. In U.S. Pat. No. 4,096,280, the coins are held with their outer edge indexed at a fixed radial position by pressing them into a rotating resilient surface and ejecting different size coins by slots, the slots being positioned about the periphery of the device and are varied as to their radial location. In both instances, a constant outer radial position is used as a reference position for coins, and sorting and dispensing occur as a united function at a discrete position around a circular periphery.

Pertinently, U.S. Pat. No. 4,607,649 discloses another device having an annular head positioned over a resilient rotating disc. It, too, employs a ramp and return recess for basically creating a single layer-single file of coins. In addition, it employs a secondary means of picking off double layered coins, this being in the form of a secondary recess which is somewhat similar to the approach employed in U.S. Pat. No. 4,444,212. Significantly, U.S. Pat. No. 4,607,649 employs an opposite edge referencing system wherein the inner edges of coins are referenced. This is accomplished by an outwardly spiralling, outwardly facing shoulder against which captured coins are urged by the rotating disc to move outwardly to a peripheral region. Then, sorting occurs along an outwardly facing shoulder which has only a slight spiral and extends substantially around the periphery of the sorter. Sorting is effected by plow devices somewhat akin to those employed in the device of U.S. Pat. No. 4,086,928, the difference being that, in U.S. Pat. No. 4,086,928, the inner edges of coins are pressed downward, and in U.S. Pat. No. 4,607,649, the outer edges are pressed downward. Sorting and dispensing are effected in the device of the latter patent by the inner edge of coins being pivoted upward into a dispensing slot, somewhat like employed in U.S. Pat. No. 4,444,212, which guides an effected coin outward. This system requires that sets of the combination of a plow and a dispensing slot be positioned around the periphery, that it be a circular or spiral periphery and of a substantial size in order to accommodate a significant numer of different diameter coins. In this respect, it is like the systems of U.S. Pat. Nos. 4,086,928 and 4,444,212.

As to the general technique of positioning captured coins against an outer facing edge, the common applicant in this case, and in the first two references cited, first employed this technique in coin exit chutes for a sorter generally of the type illustrated in U.S. Pat. No. 4,444,212 and which was offered for sale at least as early as 1979 and used this technique as a preprocessing arrangement in a coin handling device which functioned to select only one size coin, and thus was not a sorter, in early 1982, and which the common applicant understands was offered for sale no later than October of 1982.

One problem with the sorters of the prior art is that their sorting surfaces consist of quite complex lands and recesses, which result in quite high machining costs. Further, insofar as is known by the applicants, none of the prior devices provide precise accuracy in supplying a desired number of coins of a given denomination into a denominational container without some overrun into that container. Still further, and as noted above, the prior sorters integrate the sorting and dispensing functions around the periphery of a circular device, and this requires substantial space.

Accordingly, it is the object of this invention to provide a coin sorter having a sorting head which is greatly simplified and one wherein precise control is effected over delivery of a selected number of coins of a given denomination. Further, it is the object of this invention to provide a sorter which does not integrate the sorting and dispensing function for a given denomination, but instead separates these functions, enabling a significant decrease in the size of a sorter.

SUMMARY OF THE INVENTION

In accordance with this invention, instead of guiding coins outward to a peripheral position around a generally circular sorting head or plate as in all of the cited art, wherein either the inner or outer edges of coins are referenced with respect to a circular or spiral reference, the applicants' device is non-circular and effects sorting prior to coins reaching the outer boundary of the sorting head. The coins are initially rotated on a resilient disc and routed outwardly under the sorting head. Thereafter, a single layer-single file of coins is effected, and the coins are thereafter captured between the resilient disc and a sorting head. Sorting is effected by intercepting them as they are caused to travel in a path along a tapered guide edge. Interceptions of different diameters of coin are effected by a plurality of discretely positioned obtrusions in this coin path. These obstructions are the sorting elements or members, and they are spaced from the tapered guide edge a distance wherein the largest coin to be sorted is engaged between the first of the obtrusions and guide edge and is thereby urged across the guide edge. In descending order, smaller diameter coins are similarly engaged and forced across the guide edge as they travel outward along it. In this manner, each coin passes across the guide edge at a different radial position. The coins are then captured and are rotated at discrete radial position until they are rotated free of the outer edge of the sorting head. By varying the configuration of the outer edge of the sorting head in terms of its being intercepted by coins, both the position and direction of exiting coins can be adjusted.

As a further feature of this invention, the sorting elements are movably mounted and are abruptly raised as a group upon the detection of a selected number of coins being dispensed. Thereafter, coins approaching and reaching the guide edge will simply follow it to a discrete exit from between sorting head and pad.

As still a further feature of this invention, the sorting members would be discretely insulated and used as coin count detectors.

As still a further feature of this invention, means are provided to stop the sorting process on the dispensing of a selected number of coins of a selected denomination. Coins which have not yet proceeded out of a region where they are free to rotate with the disc are blocked from further progression. It is noted that U.S. Pat. No. 4,564,036 and U.S. Pat. No. 4,570,644 disclose systems where the sorting function is partially, but not completely, halted upon the sensing of a selected count of dispensed coins. In U.S. Pat. No. 4,564,036, one or two movable guides are employed to redirect coins inward when this occurs. However, some coins may still be dispensed, thus providing a coin output different from the desired and selected number of coins to be dispensed.

DETAILED DESCRIPTION OF THE DRAWINGS

Figure 1:
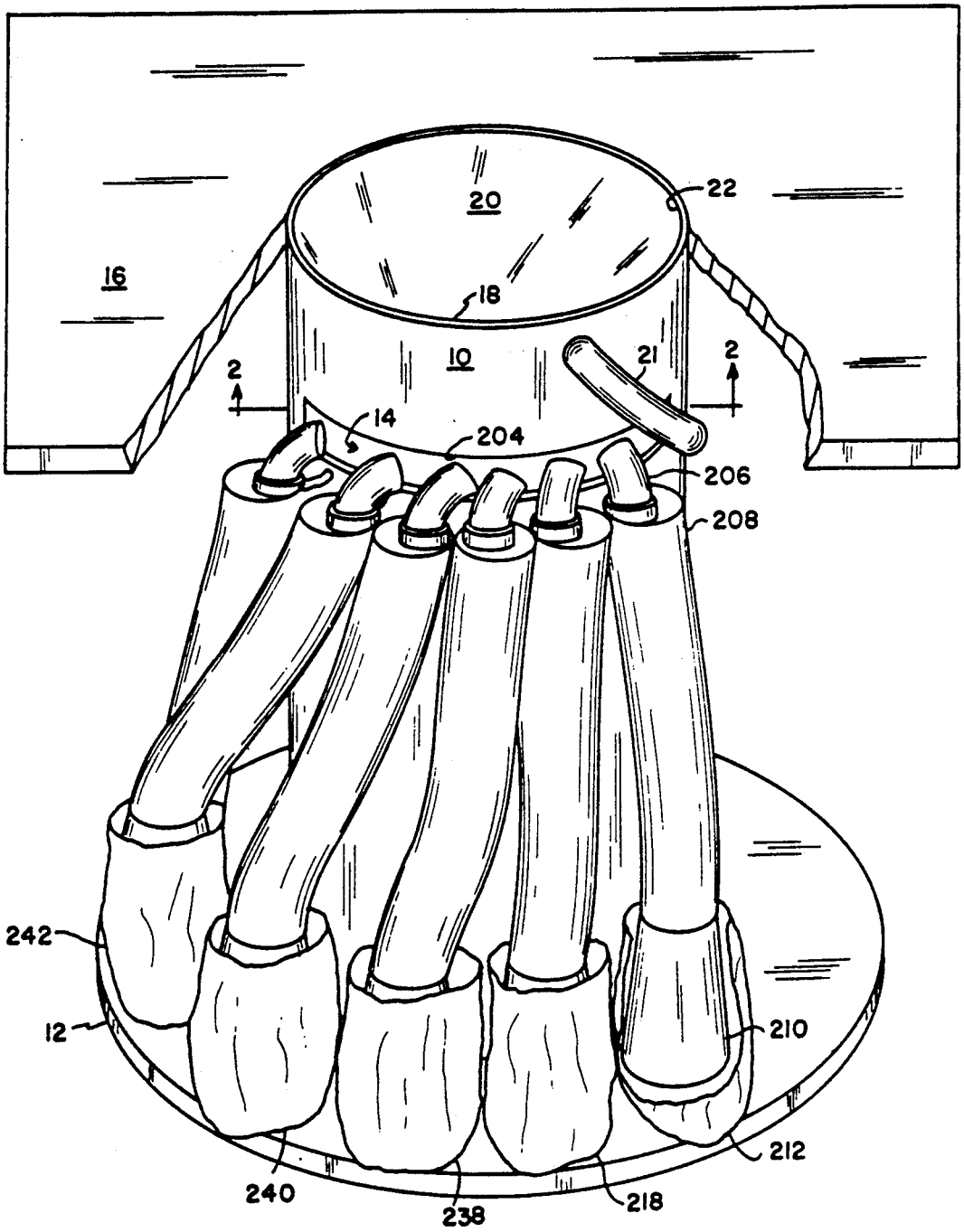
FIG. 1 is a pictorial view illustrating in general the configuration of the coin sorter of this invention.

Referring to the drawings, and initially to FIG. 1, a circular pedestal 10 supported by a base 12 houses a coin sorting apparatus 14. A table top 16 is supported at the top 18 of pedestal 10, and it provides a work surface upon which coins may be placed and inspected prior to being supplied sorting apparatus 14. Funnel-shaped hopper 20 extends from the periphery of opening 22 in table 16 through which coins from table 16 are actually supplied sorting apparatus 14.

Sorting apparatus 14 (FIGS. 2–4) includes a base plate 24 which rests on pins 26 extending through wall 28 of pedestal 10. A motor 30 is attached to the bottom of base plate 24 (by means not shown). A drive wheel 32 on motor shaft 34 frictionally engages the edge 36 of turntable 38 to drive it. Turntable 38 is supported by bearings 40 and is mounted on a shaft 42 which in turn is supported by bushings 44 and 46 affixed in shaft recesses 48 and 50. Turntable 38 is driven at a selected speed, for example, approximately 500 rpm, which typically provides a sorting speed in excess of 3,000 mixed coins per minute. Turntable 38 has a generally flat upper surface 52 upon which is affixed a flexible resilient pad 54, held down by bolted cone 55.

Figure 2:
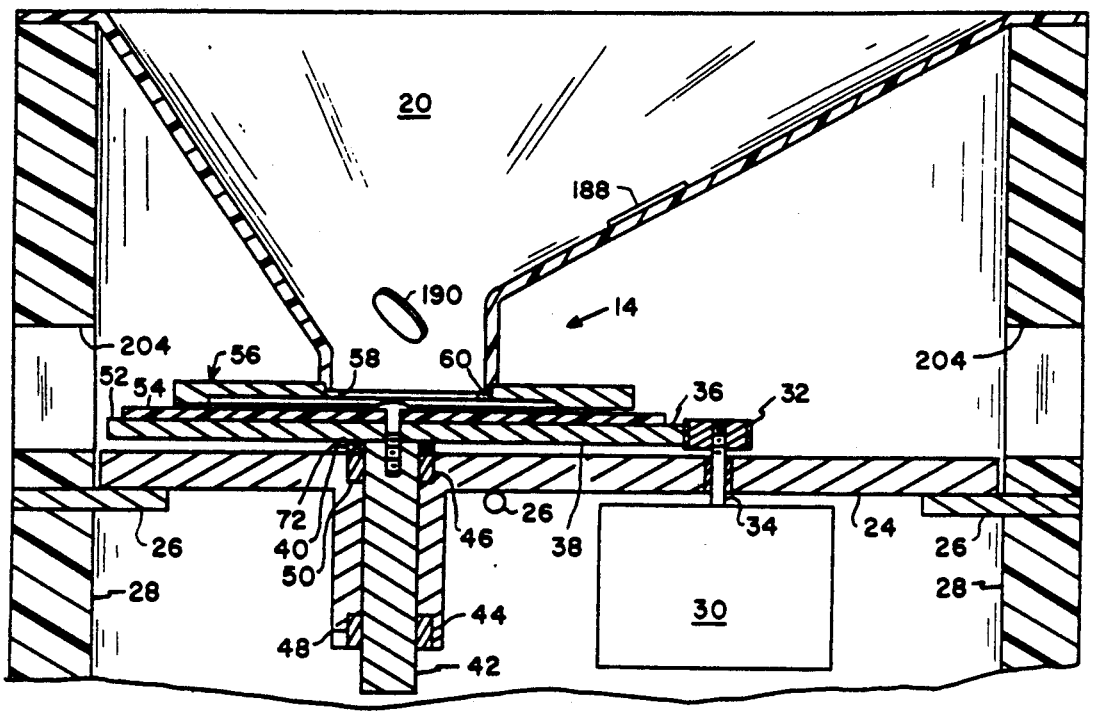
FIG. 2 is a sectional view taken along line 2—2 of FIG. 1.
Figure 3:
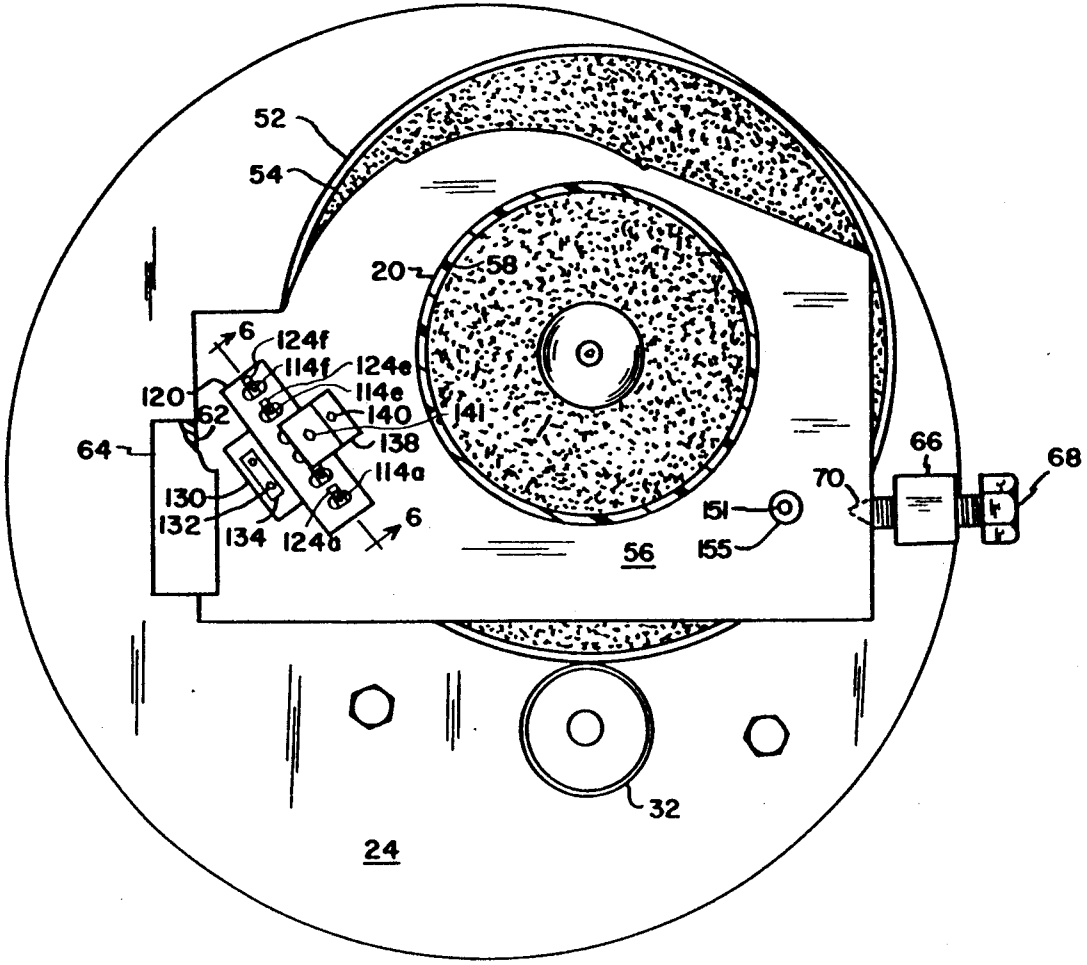
FIG. 3 is a top view of the sorting head of the sorter and support.
Figure 8:
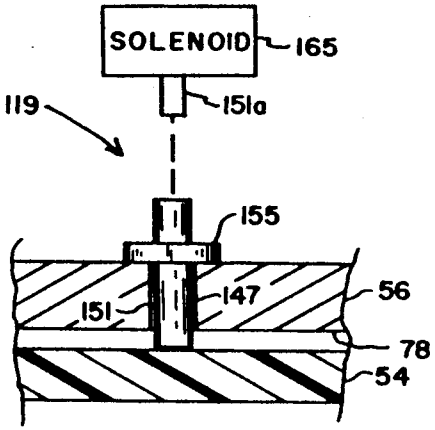
FIG. 8 is partial sectional view as seen along line 8—8 of FIG. 3 and additionally showing a solenoid connected to mechanical structure.

Coin sorting head 56 is constructed having a hardened steel lower surface and having a central opening 58 about which is included a groove 60 (FIG. 2) into which is closely fit the bottom of hopper 20. Head 56 is supported on one side by a groove 62 in mount 64 (FIG. 3), in turn supported on base plate 24 by means not shown. A second mount 66 is positioned on an opposite side of sorting head 56. It, too, is attached to base plate 24 (by means not shown), sorting head 56 being attached to mount 66 by a bolt 68 which has a tapered end 70 which enables sorting head 56 to be precisely horizontally mounted normal to the perpendicular axis of shaft 42 (FIG. 2). The spacing between sorting head 56 and resilient pad 54 is adjustable by the insertion of selected washers as shims 72 (FIG. 2) on the top of bearing 40 where turntable 52 rests, typically being adjusted to just avoid rubbing.

Figures 4, 9:
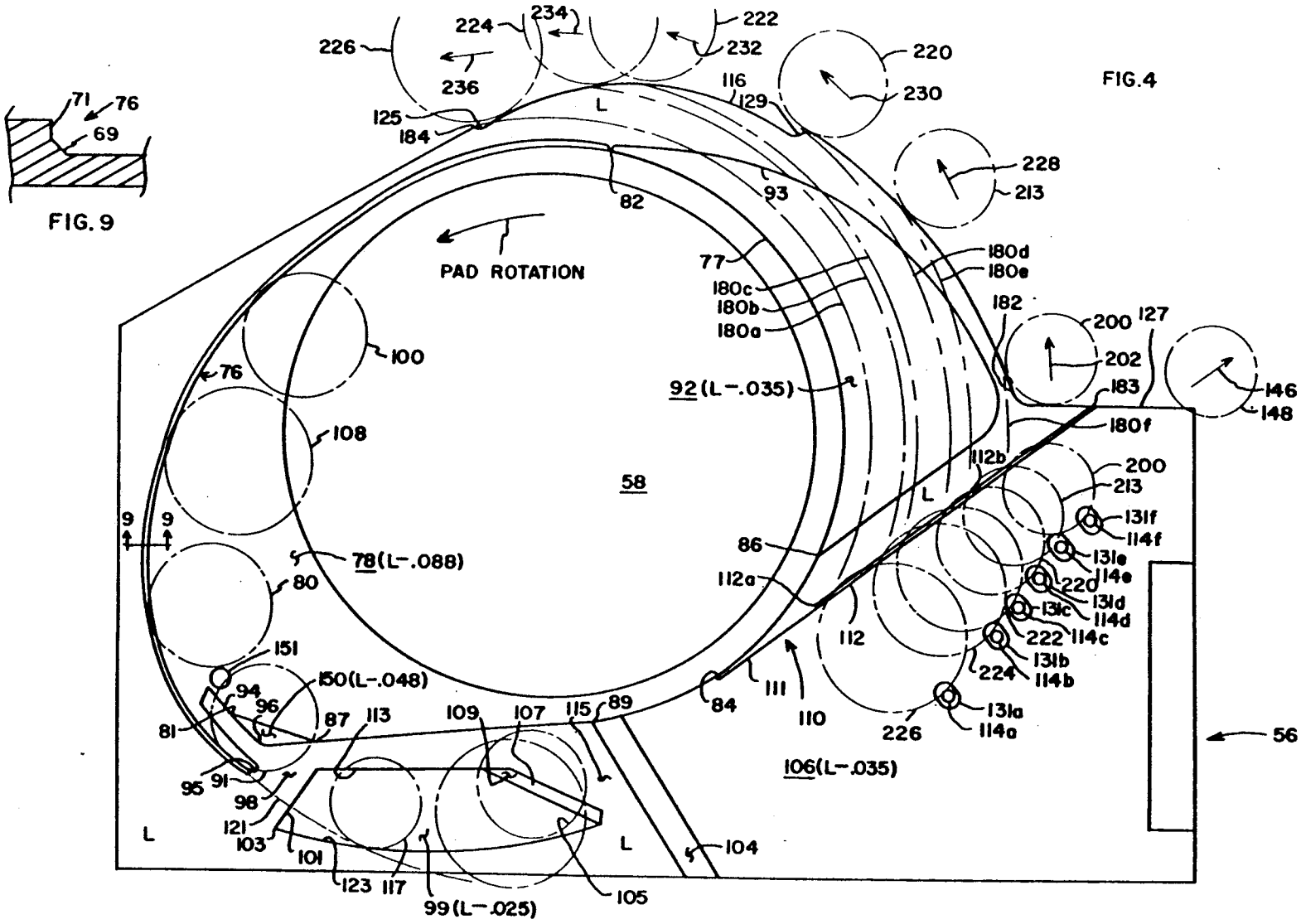
FIG. 4 is a planar view of the underside of the sorting head of the sorter and illustrating operation of the sorter.
FIG. 9 is a sectional view as seen along line 9—9 of FIG. 4.

FIG. 4 illustrates the underside of sorting head 56 which is configured with lands and recesses which control the sorting process. A basic or reference land L, while varying in edge configuration, is flat and is positioned with a slight clearance, 0.001" to 0.005", above rotating pad 54 (FIG. 2) to avoid rubbing as stated above. It extends substantially around opening 58 of sorting head 56 (FIG. 4), and as one function it provides a radial limit for coins (shown in dotted line positions) in their outward movement on rotating pad 54. A first recess or recessed land 78 is generally formed in the underside of land L of head 56, it extending from hopper 20 outward to a generally arcuate, partially tapered edge 76 (FIG. 9) of otherwise vertical edge 77 of land L. Recessed land 78 is also marked L−0.088 (indicative that it is recessed 0.088" upward from the level of land L), just greater than the thickness of the thickest coin to be sorted.

Recessed land 78 extends around opening 58 and forms a cavity within which all coins are free to be moved radially outward by centrifugal force. This enables coins to follow in an arcuate path along edge 76 in the rotational direction of rotation of pad 54 as indicated by the arrow to a radially outermost position under land 78, as illustrated by coin 80. Edge 76 is constructed as shown in FIG. 9 having a tapered upper portion 69 (as it appears in operation, with head 56 inverted from the orientation shown in FIGS. 4 and 9), which decreases bounce, and vertical portion 71, which prevents coins from moving outward under edge 76. Recessed land 78 generally bounded on its outer periphery from point 82 to point 95, from point 87 to point 89, and from point 84 to point 86 by land L. From point 89 to point 84, the outer edge of land 78 is bounded by ramp 104 and land 106 (also designated as L−0.030 as it is recessed 0.030" upward from land L). From point 84 to point 86 it is bounded by land L, and from point 86 to point 82 is bounded by recessed land 92, 0.030" above land L but 0.052" below recessed land 78.

Recessed land 92 generally functions to trap any coins which are bent or otherwise not properly processed, as will be described. After being trapped, they are guided back into center region 58 by edge 93 of land 92.

Edge 76 of land L extends counterclockwise (as shown in FIG. 4) to downwardly (as when head 56 faces downward in operation) extending ramp 94. Ramp 94 terminates at point 96 into a land region 98 of land L. Land region 98 of land L forms a transition region wherein coins are captured at their radially outermost position established by edge 76, capture being between land region 98 and pad 54. A recessed land 150, which is 0.048" above land L and is thus also designated (L−0.048), is positioned inward from ramp 94, and a portion of land L, to an edge 81 with land 78. Edges 81 presents a vertical shoulder which assists in the recirculation of coins not passing under ramp 94.

Coins are rotated under ramp 94 toward elongated recessed land 99 by rotating pad 54, which imposes a greater frictional effect on coins than the relatively slick steel surface of head 56. Recessed land 99, also designated L−0.025, is recessed 0.025" above land L. Coins initially encounter, normal to their travel, a vertical edge 101, which edge generally extends radially, and coins are rotated across it with their outer edge generally following dashed line 121. As will be noted, dashed line 121 intersects with a vertical outer wall 123 of recessed land 99. This wall functions as a guide for the smaller of coins to be sorted (for example, dimes, pennies, nickels, and quarters of U.S. coinage) and is curved to form an inwardly facing, inwardly extending spiral. The opposite or inner wall 113 of recess 99 is vertical and spaced from wall 123 such as to facilitate a relatively low angle for smaller coins as they pivot on the edge of wall 113 when their outer edge rises into recess 99. The outer edge of small coins rise sufficiently as to be engaged by wall 123 and are guided inward along it. The far side of recess 99 is bounded by wall 107 and is tapered downward with a ramp 109 which, in terms of direction of rotation of coins, extends backward from the outside to inside, to intersect with a far end of inner wall 113. A region 115 of land L extends around recessed land 99, and from the far edge of ramp 109 to a transition edge of ramp 104. Ramp 104 extends higher by 0.035" to recessed land 106, which is also labeled L−0.035. It effects lessened pressure on coins which will enable them to be more readily moved outward from a normal circular path as required by the next manipulation of coins.

To examine coin movement by the structure thus far described, coins, such as coins 100 and 108, initially proceed clockwise and radially outward to edge 76 and then proceed along it, to the right in FIG. 4, to ramp 94. Ramp 94 effects a downward transition from recessed land 78 to a region 98 of land L, the coins being captured between relatively slick head 56 and relatively frictional pad 54 and are forced to move circularly as they make such a transition. As a result, the coins are initially moved circularly with their outer edge along dashed line 121. The spacing between vertical edge 123 and opposite vertical edge 113 is such that the smaller coins referred to above tilted and at their outboard edge tilted upward into recessed land 99 by pad 54 and, as illustrated by coin 117 (representative of a dime), the outer edge engages the inside of vertical edge 123, causing movement of these coins to be guided by edge 123 in a spiral path radially inward as they are rotated.

Next, the inward and forward region of the smaller coins pass downward under ramp 109 of edge 107 with rotation and are then flattened and fully captured by region 115 of land L which follows recess 99. This occurs at slightly different radial positions for different diameter smaller coins as they are further captured, the coins now being rotated at discrete fixed radial positions under region 115 of land L. As stated, this occurs for smaller coins (dimes, pennies, nickels, and quarters of U.S. coinage).

Larger coins (Susan B. Anthony dollars and half dollars of U.S. coinage) are simply captured under ramp 94 and rotated at a fixed radial position under recessed land 99, the larger coins possessing a diameter which enables them to be pressed flat between land L and pad 54 and their outer part to pass over recessed land 99. Thus, the larger coins are unaffected by recess 99 and are rotated under ramp 109 of land L at a fixed radial position toward ramp 104, while smaller coins are tilted into land 99 at their outboard edges and moved radially inward by edge 123 as they are rotated toward ramp 104.

The object of the inward movement of smaller coins is to limit the radial excursion of their inner edge (by limiting the outer travel of their outer edge), which inner edge would inherently, without special treatment, move farther outward than would the inner edge of larger coins since the outer edges of coins are initially referenced by their outer edge to edge 76. The purpose of the limitation is to generally bring together the paths of the forward edges of coins of different diameter to facilitate presorting manipulation, as will be further described.

The presorting manipulation referred to is effected after the coins pass upward under ramp 104 and to a position under land 106 which, as stated, is, for example, 0.035" above land L. The coins thus remain captured (all coins are assumed to have a thickness of greater than 0.035") and as captured are circularly rotated by pad 54. They are rotated until they strike vertical edge 111 of wall 110 of land L, this wall extending linearly as shown to the edge 127 of head 56. Edge 111 is positioned to intercept the forward edge of all size coins and, being vertical, it functions to block them from passing under it and forces the coins to travel outward along it and wall 110. In order to make the head compact, it was discovered necessary to limit the length of vertical edge 111 of wall 110, and to do this, small size coins were moved inward as described so that they, as well as larger coins, would strike edge 111 within as short as possible a length of edge 111.

Next, mixed diameter coins, captured between recessed land 106 and rotating resilient pad 54, are thereby forced outward along wall 110 of land L and particularly along the outer tapered edge 112 of the wall. Edge 112 is tapered approximately 25° from vertical from point 112*a* to point 112*b* and 30° from point 112*b* to point 183 (this difference in slope will be discussed below). If a coin proceeding along this edge is further urged against it, the coin will tend to ride diagonally downward and under the wall and be captured between land L and pad 54. The 30° tapered portion of edge 112 assists smaller coins in passing under this edge. Urging of coins under tapered edge 112 is effected by discrete pins of pins 114*a*–114*f* when the pins are in a lowered position and a coin is engaged between tapered edge 112 and a pin. As will be noted, each pin is at a different distance from edge 112; and as shown in FIG. 4, the distance between a pin and edge 112 decreases with outward distance of location of a pin. By this configuration, each pin urges or forces a different diameter of coin under edge 112, and thereby the function of sorting in terms of diameter is achieved. Since most coinage systems employ different diameter of coins for different denominations, denominational sorting is thus achieved.

Figure 5:
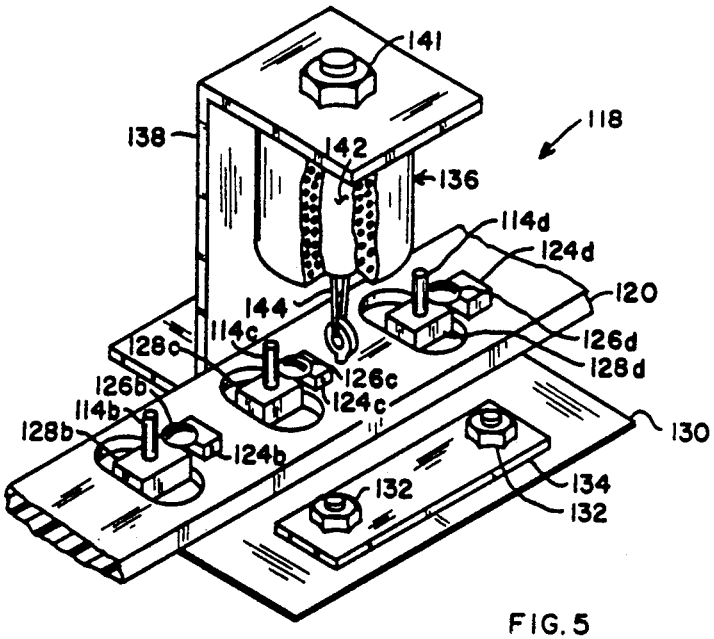
FIG. 5 is a detail of construction in the form of a pictorial view, this view being of a portion of a sorting pin assembly.
Figure 6:
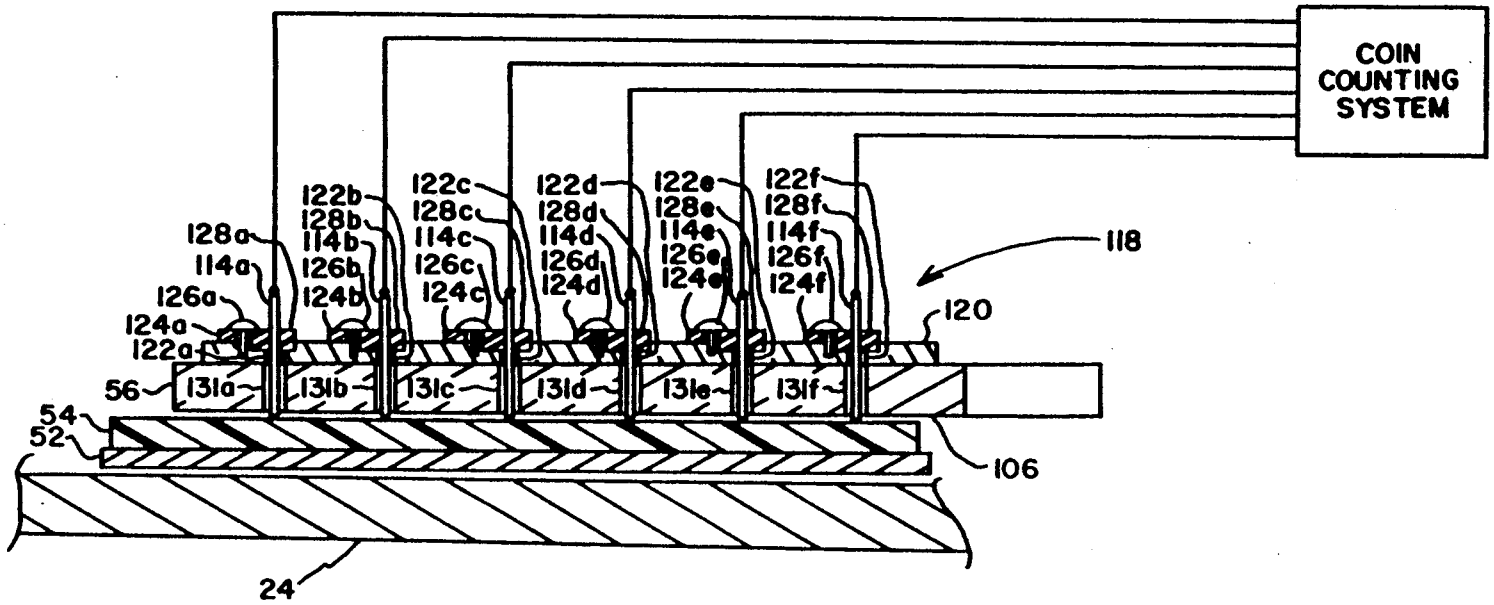
FIG. 6 is a view, partially sectional and partially schematic, illustrating the construction of the sorting pin assembly and its electrical connection to a coin counting system.

FIGS. 3 and 5–8 illustrate the construction of sorting pin assembly 118 and stop pin assembly 119. Pin assembly 118 includes an insulative plate 120 having a plurality of openings 122*a*–122*f*. Pins 114*a*–114*f* are mounted in discrete metal blocks 128*a*–128*f*, which in turn are mounted over openings 122*a*–122*f*, with pins 114*a*–114*f* extending through openings 122*a*–122*f*. Bolts 126*a*–126*f*, in conjunction with shoulder insulating blocks 124*a*–124*f*, hold blocks 128*a*–128*f* and thus pins 114*a*–114*f* in place as shown in FIG. 6. Pins 114*a*–114*f* normally extend through openings 131*a*–131*f* in head 56 below the lower surface of land 106 and approach the surface of pad 54, being normally spaced (during sorting) approximately 0.001" from pad 54. Plate 120, on which the pin assemblies are mounted, is attached by bolts to spring steel member 130, which in turn is attached by attachment bolts 132 and plate 134 to head 56. By this arrangement, plate 120 and thus pins 114*a*–114*f* may be raised and lowered by the hinge action of spring steel member 130. Normally, spring steel member 130 biases plate 120, and thus pins 114*a*–114*f*, to a lowered position as described for sorting operation. Plate 120 and pins 114*a*–114*f* are selectively raised by solenoid 136, which is mounted on a mounting bracket 138 by nut 141, and bracket 138 is attached by bolt 140 to head 56. Solenoid 136 includes a plunger 142 which is coupled by link 144 to plate 120. When power is applied to solenoid 136, plunger 142 is retracted, pulling plate 120 and thus pins 114*a*–114*f* upward to a raised position above pad 54. When they are raised, coins reaching the region below the pins exit along the straight edge of wall 110 and the line of arrow 146 and as illustrated by coin 148 in FIG. 4. Alternately, the solenoid may be mounted to the top surface of sorting head 56, with the plunger connected to a rocker arm (not shown) which is vertically coupled to plate 120. In this case, the solenoid, when energized, would pull the rocker arm horizontally, lifting plate 120 and pins 114*a*–114*f* vertically as described.

As an optional feature, means are provided for blocking the passage of coins over and beyond ramp 94, and thus sorting of coins, after a selected number of coins of a particular denomination has been delivered. This eliminates the necessity of completely emptying the sorter after a run to obtain a selected number of coins of one denomination. To accomplish this, a stop pin assembly 119 (FIGS. 3 and 8) is employed having a pin 151 which extends through an opening 147 in head 56. When lowered, pin 151 is spaced to approximately 0.001" of pad 54 and is positioned as shown in FIG. 4 just adjacent ramp 94. A collar 155 extends around a central region of pin 151 and limits the downward travel of pin 151 by its engagement with an upper surface of head 56. Pin 151 is operated by solenoid 165, being coupled to the armature of the solenoid by pin 151*a* through means which are not shown. Pin 151 is coupled to pin 151*a* as diagrammatically shown in FIG. 8. Normally, when solenoid 165 is unpowered, pin 151*a*, and thus pin 151, is maintained in a raised position; and when power is applied, pin 151 is lowered to the position shown in FIG. 8. Pin 151 is lowered simultaneous with the raising of pins 114*a*–114*f*, and pin 151 provides a barrier which prevents coins from riding under ramp 94, blocking the further outward flow of coins and halting the sorting process. Vertical wall 71 of edge 76 (FIGS. 4 and 9) presents a barrier to coins which would otherwise move around the outside of stop pin 151. Coins which are in the central region of the sorter and in recess 78 remain there. Coins which are moving between pin 151 and point 183 are moved by pad 54 along edge 110 and ejected from under head 56, as illustrated by coin 148 in FIG. 4. These coins, usually two to six, then enter a coin return chute 21 (FIG. 1) having an entrance (not shown) positioned to intercept coins ejected along edge 110. Chute 21 is configured to return these coins to hopper 20 for resorting. Head 56 is configured such that coins are dispensed with sufficient velocity to effect this movement. The operation of pin 151 prevents emptying the sorter of all coins following the raising of pins 114*a*–114*f* and the turning off of motor 30. While motor 30 is turned off at the same time as the operation of pins 114*a*–114*f* are raised, rotating pad 54 may coast, and a significant number of coins may exit along edge 110. Stop pin assembly 119 significantly reduces this number.

As described above, sorting of coins is effected when a particular one of pins 114*a*–114*f* forces a coin under edge 112 at a unique point along edge 112 as a function of the spacing of that pin from edge 112. Thus, sorting of coins is achieved by the different combinations of wall pin dimensions and their location, sorting thus being accomplished at what are actually different radial positions. As they pass under edge 112, the coins are captured at their discrete radial position by the combination of land L and pad 54. They then follow a discrete circular path as shown in FIG. 4 as a function of their diameter. To ensure this, the configuration of land L is such that some portion of it always presses on and retains the capture of a coin at a discrete radial position as the coins are rotated along the paths of lines 180*a*–180*f* until they pass under outer edge 116 of land L and are dispensed. The less steep edge of edge 112, from point 112*b* to point 183, being 30° rather than 25° as it is from point 112*a* to point 112*b*, assists in smaller coins being forced under edge 112 and reduces their dwell time on one of the sorting pins, particularly pins 114*e* and 114*f*.

As a particular distinction from the sorters of the prior art referred to above, dispensing is in the inverse order along the edge of plate 56 to that of sorting. In other words, while large coins are sorted first, they are the last to be dispensed. Dispensing occurs in the region between point 183 and point 184, which is configured to spread or space dispensing as desired. As shown, edge 116 is turned inward from point 183 and then generally circles outward to point 182, where the arc of the edge reverses, then follows a generally circular arc until it reaches point 184. If desired, notches, such as notches 129 and 125, immediately reduce or increase the curvature of edge 116, providing a way to adjust the exit point of a selected diameter coin without adjusting the point of sorting. With this configuration together with the capture of each different denomination of coin at a different radial position, each coin is released by land L at a different circumferential position as illustrated in FIG. 4.

Figure 7:
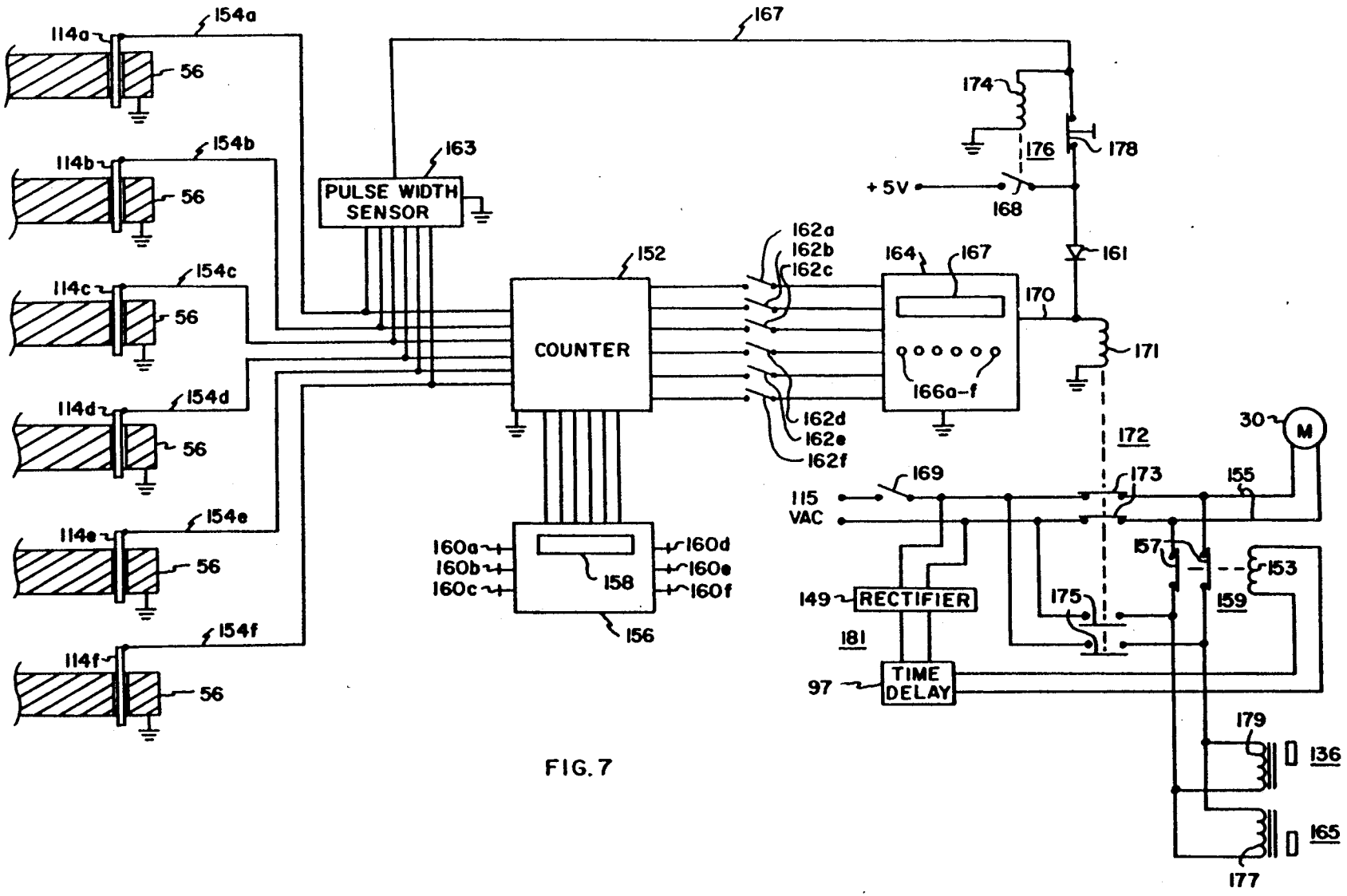
FIG. 7 is an electrical block diagram illustrating a coin counting system as contemplated by the invention.

Referring to FIG. 7, operating power for sorting operation is provided through switch 169 and normally closed contacts 173 and leads 155 to motor 30. In order to ensure that operating speed for motor 30 and thus rotating resilient disc 54 is achieved before actual sorting is commenced, there is provided time delay circuit 181. This circuit includes a rectifier 149 which rectifies the 115 volt A.C. input voltage at switch 169 and then feeds the rectified voltage to time delay unit 97. This unit is conventional and may consist of a resistance-capacitance charging circuit wherein a capacitor is charged, with time, through a resistor, and when the voltage on the capacitor reaches a selected value, this value, as an output, energizes coil 153 of relay 159. Relay 159 is a double pole, single throw relay having normally closed contacts 157. When switch 169 is closed, the normally closed contacts 157 initially supply power through contacts 173 to coils 179 and 177 of solenoids 136 and 165 and sorting is prevented. After the delay interval of delay circuit 181, e.g., approximately two seconds, rotating disc 54 will have reached operating speed, and the output voltage of the delay circuit will have risen to sufficient voltage to operate relay 159 to open contacts 157. This removes power from solenoids 136 and 165 to a sorting mode. Thus, initially, pins 114*a*–114*f* are pulled up by solenoid 136 and pin 151 pushed down by solenoid 165. Thereafter, time delay circuit 181 operates to disable relay 159, allowing the pins to reverse their position and sorting operation to commence.

The control of the sorting process, and particularly the halting of sorting after a selected number of coins of one denomination pass through the sorter, is controlled by the electrical system shown in FIGS. 6 and 7. Each of insulated pins 114*a*–114*f* is connected to coin counter 152. Coin counter 152 is of a conventional type for counting events, and in this case, each instance of the encounter of a given diameter of coin with a discrete pin. When this occurs, a closed electrical or continuity circuit is effected between a pin and head 56, which typically would lower the voltage applied by counter 152 to one of leads 154*a*–154*f* from +5 volts to zero. This effect is achieved in coin counter 152 via one of leads 154*a*–154*f* and a common ground connection between the sorter head and coin counter 152. Thus, with this configuration, coin counter 152 senses an electrical impulse each time that a coin strikes an associated pin, and thus, coin counter 152 is configured to separately count each denomination of coin. It then provides a count for each denomination of coin to coin count storage and totalizer 156, which conventionally multiplies each count of each denomination by the denominational value of a coin and then makes available at readout 158 a total dollar amount of a particular coin and the total dollar amount of all coins counted. Additionally, totalizer 156 includes conventional circuitry for displaying on readout 158 a coin count for each coin. A selection of either a total value or a discrete coin count is typically provided by control buttons 160*a*–160*f*.

There is illustrated as a separate set of electrical outputs of coin counter 152 discrete outputs for each denomination counted which are supplied through selector switches 162*a*–162*f* to count select 164.

Count select 164 is basically a digital comparator wherein one would enter a selected number representative of the number of a given denomination of coin (or dollar amount) that is desired as an output from a sorting function. Thus, if it were desired to stop the sorting process when there were 1,000 dimes processed through the sorter, 1,000 (or dollar amount) would be entered in count select 164, as by toggling one of decade select buttons 166*a*–166*f* to enter a number for each decade. This number would then be placed in memory and displayed by readout 167. When the selected count occurs from the operation of the sorter, there would be parity or identity between the selected count and an output of coin counter 152, and count select 164 would produce an electrical output, e.g., +5 volts, on lead 170. This output is coupled to coil 171 of relay 172 which, when energized, opens normally closed set of contacts 173, turning off motor 30 and closes normally open set of contacts 175, which energizes coil 177 of solenoid 165 and coil 179 of solenoid 136. Solenoid 165 then lowers pin 151 (FIGS. 4 and 8) to stop the flow of coins being sorted while solenoid 136 causes plate 120 (FIGS. 3–7) to be raised upward, raising pins 114*a*–114*f* and thus enabling the few coins between pin 151 and pins 114*a*–114*f* to be recycled via chute 21 to hopper 20. Additionally, coin select 164 may include circuitry for enabling an operator to sequentially select for the dispensing of selected numbers of several denomination coins, and a halt signal would be provided as each of the selections was reached during a starting procedure which would be halted and restarted until the last of the selected dispensations is effected. Where several selections are to be made, the appropriate ones of switches 162*a*–162*f* would be closed.

Alternately, relay 172 would include a double throw contacts which would provide for a higher voltage to be initially impressed upon solenoids 136 and 165 to effect quick closing and then a lower voltage to be applied as a holding voltage.

In the event that a coin becomes jammed between edge 112, and one of pins 114*a*–114*f*, as would be the case when a bent or damaged coin, or foreign coin, is introduced into sorter 14, circuitry is provided to operate the solenoids, which prevents the feed of further coins for sorting and ejects the offending coin. To accomplish this, the count detection signals from pins 114*a*–114*f* are fed to a pulse width sensor 163. As noted above, such a signal is a zero voltage pulse dropping from a normal 5-volt state. Pulse width sensor 163 senses when such a pulse persists for longer than the longest anticipated dwell of a coin on a pin in normal operation. For example, this might be approximately 3 milliseconds. Such circuitry, for example, might include an inverter in each lead from a pin, and this inverter would then translate a zero voltage pulse occurring when a coin hits a pin to, for example, a 5-volt pulse for the period of time of dwell of a coin on a pin. Then, each of the outputs of these inverters would be fed through an isolating diode to a timing capacitor connected in parallel with a discharging resistor. Thus, voltage on the capacitor would increase with time that a coin bridged between a pin and head 56 and discharged in between times. In any event, pulse width sensor 163 would be operated to provide an operating voltage on lead 167 and across relay coil 174 of relay 176 when a jam condition occurs.

Relay 176 is arranged in the circuitry as a latching relay, there being supplied a holding voltage for coil 174 through normally open contacts 168 and normally closed switch 178. When coil 174 of relay 176 is operated by pulse width sensor 163, it pulls closed contacts 168 which then apply a positive voltage, for example, +5 volts, through isolating diode 161 to coil 171 of relay 172. As a result, relay 172 is operated to open contacts 173 and close contacts 175, halting the outward flow of coins to pins 114*a*–114*f* and causing the pins to be raised and stop the sorting process. Since, however, rotating disc 54 will not immediately stop the outward movement of coins, including a jammed coin, the latter would exit to chute 21 and hopper 20 after power to motor 30 is interrupted.

In order to restart operation, first, switch 169 would be operated open, and then normally closed switch 178 would be operated open, removing power from coil 171 of relay 172, readying the system for continuing the sorting sequence being performed. It is to be noted, however, that since the offending coin removed by the process just described has been counted, the procedure followed by the operator should probably be to redo the sorting sequence halted by this coin. Alternately, circuitry may be included to compensate in the count select circuitry for an overcount.

To examine the overall operation of the sorter, and assuming that it is desired to deposit a selected number of coins of a particular denomination in a bag, the switch or switches 162*a*–162*f* would be closed, and the number or numbers (of different denomination coins) would be inserted in count select 164 as described and would be indicated by display 167. Next, switch 169 would be closed, and motor 30 would be turned on. Time delay circuitry 181 would briefly apply power, through relay 159, to solenoids 136 and 165, disabling sorter 14 until rotating disc 54 reaches operating speed as described. After this occurs, time delay 97 removes power from solenoids 136 and 165, allowing sorter 14 to commence operation. Coins of different denomination, for example, a mix of half dollars, Susan B. Anthony dollars, quarters, nickels, pennies and dimes (U.S. denominations), would be emptied into hopper 20 (FIGS. 1 and 2) which would then funnel coins onto the center region of rotating pad 54 as illustrated by coins 188 and 190 of FIG. 2. Coins are then urged under recess 78 (FIG. 4) by centrifugal force from rotating pad 54 (e.g., coins 80, 100, and 108) and travel circularly until they are generally aligned in a single file along edge 76 of land L. Then they ride under ramp 94 (coin 91) where coins are pressed down into resilient pad 54 and are thus captured and moved circularly toward recessed land 99. Upon encountering recessed land 99, smaller coins are moved inboard by edge 123 and thus to ramp 104, while coins having a larger diameter pass over land 99 and are moved at a constant radial position from ramp 94 to ramp 104. Next, all coins pass under ramp 104 and thus to land 106 where they strike edge 111 of land L and are then moved outward and along edge 112. As shown in FIG. 4, coins move along edge 112 until a coin strikes one of the series of pins 114*a*–114*f*. As will be noted, when this occurs, this coin is urged under the slope of edge 112 and is then captured by land L and rotated circularly, being discharged at a discrete location around edge 116 of head L as described.

The smallest coin 200, e.g., a dime, following the direction of arrow 202, would move through slot 204 (FIG. 1) and then through L-shaped coupling 206, tube 208, funnel 210, and into bag 212. In the same manner, the next largest coin, for example, a penny, would be moved outward through slot 204 downward through a like assembly into a bag 218. In the same manner, the next larger coins, coins 220, 222, 224, and 226 (for example, a nickel, quarter, Susan B. Anthony dollar, and half dollar) would move in the direction of arrows 228, 230, 232, 234, and 236 and then in a like manner into bags 238, 240, and 242. This process proceeds until count select 164 senses that a desired number of coins of the selected denomination have passed into a bag for that denomination. Upon reaching the selected count, count select 164 sends an electrical output to relay 172. This cuts off power to motor 30 and supplies power to solenoids 136 and 165, which lowers pin 151 and raises pins 114*a*–114*f* which prevents any other coins from moving outward from the hopper and causes sorting to cease. Residual coins outside of the central hopper are passed by return chute 21 into hopper 20 to be resorted in a new cycle. Power switch 169 is then opened, returning pins 114*a*–114*f* and stop pin 151 back to a sorting mode. When sorting is to be resumed, the operator enters a desired number (if not already entered as described above) into count select 164, operates switch 169 to supply power to motor 30, and fills hopper 20 with coins, and operation will again be effected as described.

Bent coins reaching or otherwise riding along edge 111 may be forced by rotating pad 54 under this edge, in which case they are rotated under land L and directly into recessed land 92 where they encounter edge 93 and are returned to central opening 58. With the motor stopped, a bent coin would then be removed. Bent or foreign coins which become jammed between one of pins 114*a*–114*f* in edge 112 would be ejected as described above. This would result in the coin being recycled via chute 21 to hopper 20. The operator would then locate and remove the offending coin from hopper 20.

Figure 10:
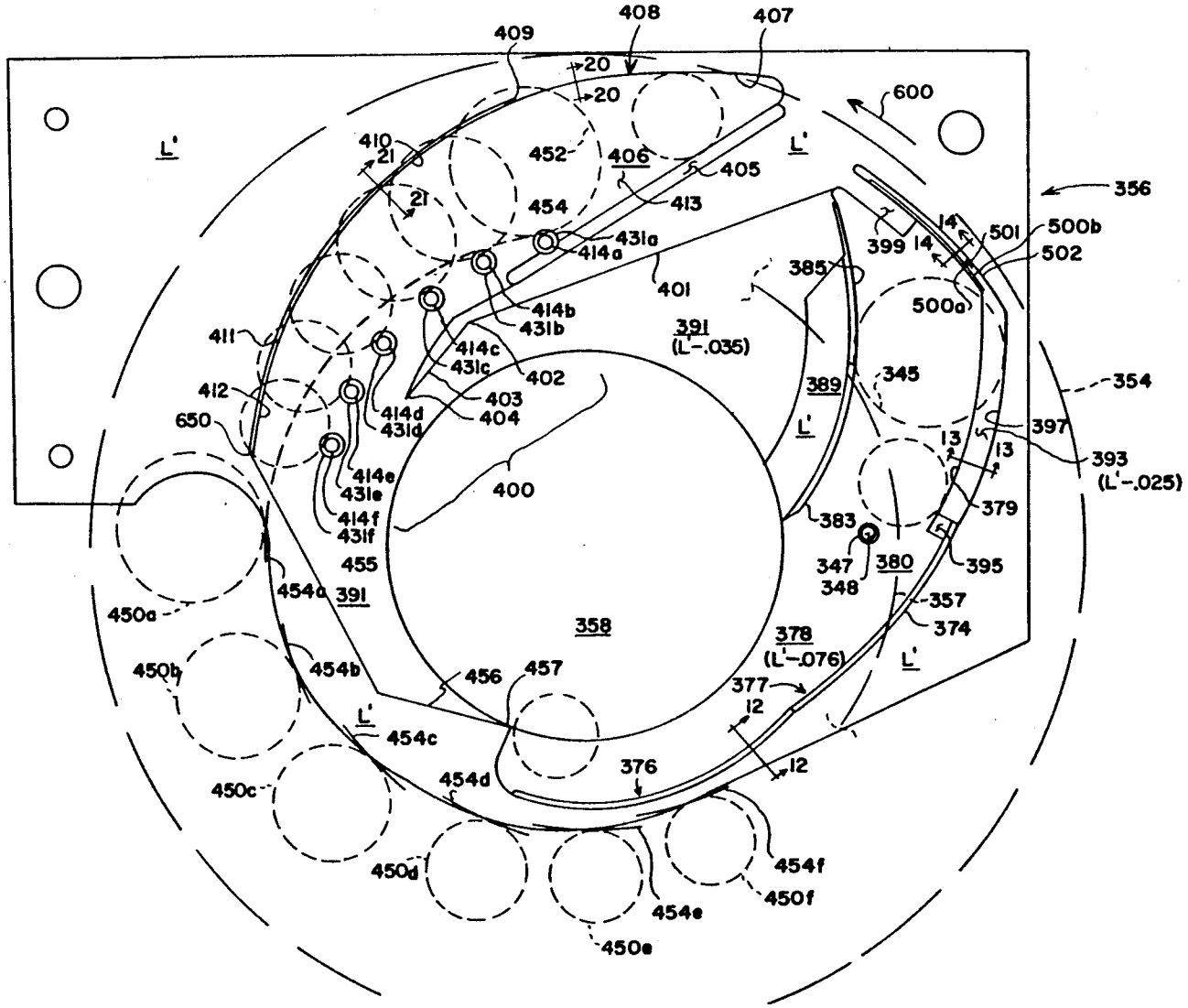
FIG. 10 is a planar view of the underside of an alternate embodiment of the sorting head.

FIG. 10 illustrates an alternate embodiment of the sorter head 356 of the invention wherein coins are generally directed along a sorting path from a radially outer position inward to a radially inner position and wherein if the sorting process is halted, all coins will be returned to a central region 358 of the sorter and no unsorted coins ever exit the sorter. This is in contrast to the operation of the embodiment shown in FIG. 4 wherein excess coins do exit.

Figure 15:
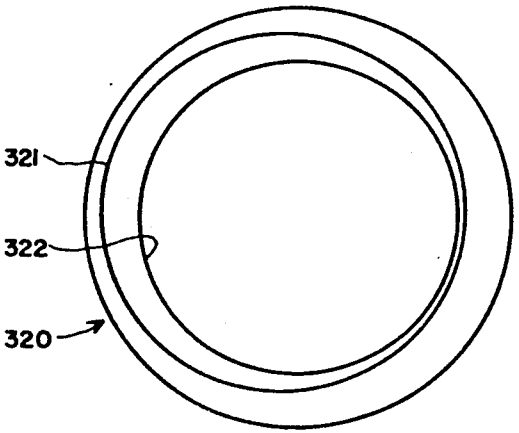
FIG. 15 is a plan view of a hopper as partially shown in FIG. 11.
Figure 11:
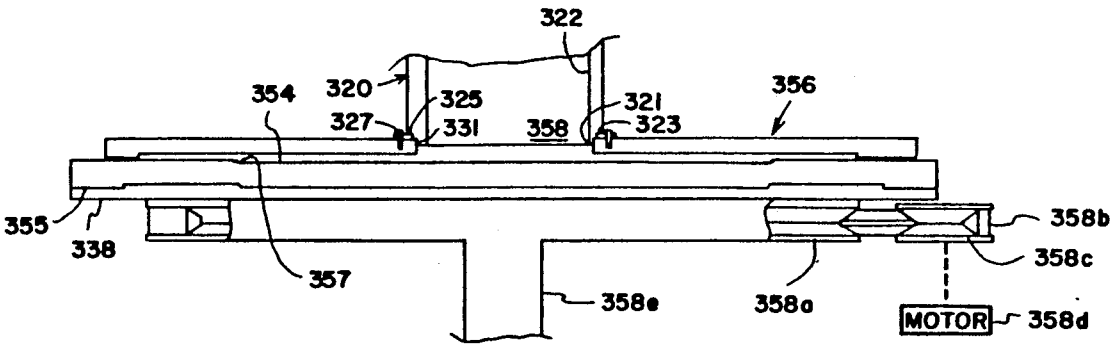
FIG. 11 is an elevational view, partially cut away, illustrating certain features of the invention and in conjunction with the sorting head of FIG. 10.

FIG. 11 particularly illustrates a modification of the turntable, in this instance, turntable 338, in which a generally flat, resilient disc or pad 354, except in hold-down region 355, is pulled 0.010" to a contoured lowered position at a radial position 357 (dashed line diameter in FIG. 10), this to accommodate a facet of contour and operation of sorting head 356. Sorting head 356 and hopper 320 are particularly cut-away to illustrate mounting of the hopper. Hopper 320*a*, through which coins are loaded onto pad 354, is configured to have a lower circular region 321 (FIGS. 11 and 15), which partially extends into opening 358 of sorting head 356. The inner wall 322 of the hopper is eccentric with respect to region 321 and the rotating center of pad 354. This prevents coins from riding on edge around the inner wall of hopper 320. Hopper 320 is also provided with a groove 323 on an exterior side adjacent the upper surface of head 356, with tabs 322 engaging groove 323. Tabs 322 are affixed to head 356 by bolts or screws 327. In this manner, hopper 320 is mounted to sorting head 356. Further, turntable 358 is driven by an attached pulley 338*a* via a belt 338*b* from a pulley 358*c* attached to a motor 358*d*. A supporting shaft 358*e* of the turntable is rotationally mounted, for example, as illustrated by the mounting of turntable 52 in FIG. 2.

Figure 12:
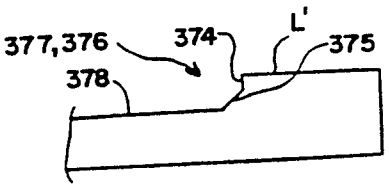
FIG. 12 is a sectional view taken along line 12—12 of FIG. 10.

Referring to FIG. 10, a basic or reference land L', while varying in edge configuration, is flat and is positioned with a slight clearance, 0.001" to 0.005" above adjacent outer portions of resilient pad 354, this clearance being utilized to avoid rubbing. Land L' extends substantially around opening 358, and as one feature, it provides a radial limit for coins (shown in dotted line positions) passing under head 356 on pad 354. A first recessed land 378 is generally formed on the underside of land L' of head 356 and is marked L'-0.076, indicating that it is recessed 0.076" upward from the level of land L'. Recess 378 extends outward from hopper 320, first to arcuate edges 376 and 377, these edges being configured as shown in FIG. 12 with an upper tapered region 375, at an angle of approximately 35° from the vertical, and a lower straight wall portion 374. Recess 378 of 0.076", together with the 0.010" contoured recess in pad 354, provides an effective recess inboard of line 357 which is greater than the thickness of the thickest coin to be sorted but of less depth than two of the thinnest coins when one is stacked on another. Outboard of dashed line 357, the total clearance is approximately 0.076", which is slightly less than the thickness of the thickest coin to be sorted, a half dollar, being approximately 0.080" in depth. By this configuration, a half dollar readily feeds out from opening 358 and enters the sorting process.

Recess 378 extends outward and around opening 358 and separates from opening 358 to form an outwardly spiralling channel 380 within which coins are moved with their outer edges moving against edge 377. The inner edge of this channel is formed by tapered edges 383 and 385 of land 389, these tapered edges extending downward to the level of land L', edge 383 being tapered from the upper surface of recess 378 at 30°, from vertical, while edge 385 is tapered 45°. Edge 383 urges a half dollar outward against edge 377 along which it rides, and edge 383 enables stacked coins or coins not properly moving through channel 380 to pass under edge 383 of land 389.

Land 389 is bounded on its inner edge by coin recirculating recess 391, which is recessed from land L' by 0.035", and thus the alternate designation of L'-0.035 as shown.

As will be noted, a small portion of recess 378 is also bounded by recess 391.

Figure 13:
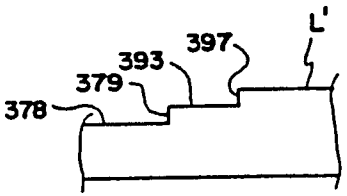
FIG. 13 is a sectional view taken along line 13—13 of FIG. 10.
Figure 14:
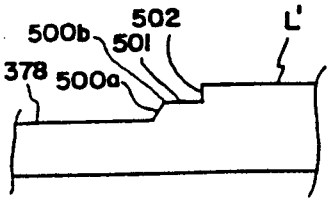
FIG. 14 is a sectional view taken along line 14—14 of FIG. 10.

As shown in FIGS. 12, 13, and 14, outer edge portion of recess 378 extending counterclockwise around from edge 377 is bounded by the inner edge 379 of adjacent recess 393 and beyond this by tapered edge 500*a* adjacent recess 501, which is an extension of recess 393. Continuation recess 393 extends downward from recess 378 to a depth of 0.025" from land L' and is bounded on its outer side by vertical wall 397. Recess 501 extends downward from recess 378 to a depth of 0.025" from land L' and is bounded on its outer side by a vertical wall 502. At the extreme counterclockwise region of recess 378, it is effectively terminated by a ramp 399 which enables coins in channel 380 to be gradually captured, it effecting a transition from a level of recess 378 to that of land L'.

Coins fully outboard and against edge 377 are moved counterclockwise and engage ramp 395, are captured, and are then moved under recess 378. Half dollars are forced to this position by edge 383, and thus half dollars must ride under ramp 395 and around and under recess 393 in a single file as shown for half dollar coin 345. As also shown, this coin is forced outward against the vertical outer wall 397 of recess 393, it extending vertically down to land L'. Next, half dollars with an outer edge region under recess 393 reach recess 501 which is of the same level and a continuation of recess 393. However, as is noted, instead of spiralling outward as recess 393, it generally extends in a circular direction, and thus its outer edge 502 forces half dollars to follow it, whereby they are forced under tapered edge 385, moved under ramp 399, and captured by land L'.

Coins smaller than a half dollar proceed around recess 378, with coins which ride under ramp 395 being rotated back into recess 378. These coins ride in a single file within recess 378 with their outer edge limited in outward travel by edge 379 of recess 393. Coins follow this edge until engaging tapered edge 500*a* extending to edge 500*b* of recess 501, the coins being circularly rotated with their outer edges against tapered edge 500*a* which prevents bounce until they are captured by being rotated under ramp 399. These, smaller, coins then pass under ramp 399 with their outer edges against edge 500*b*, while their inner edges pass under edge 385 of land 389. Coins are then captured under land L' prior to being circularly rotated into sorting recess 406.

Coins which become stacked or wedged in channel 380 are rotated toward edge 383 of land 389, with the result that the bottom coin of stacked coins or forward coin of wedged coins will be pulled under edge 383, captured by land 389 and thereby rotated by the pad into region 391, and then against edge 401 of land L'. As shown, edge 401 turns inwardly along edge 403 at point 402 and terminates at point 404. The result then will be that such a coin or coins are moved to the left along edges 401 and 403 until they are moved back into the central region 358 of the sorter and recycled.

Properly moving coins, coins which have their outer edges against edge 500*a* or 502 and rotated as described above under land L', will next be rotated circularly under upwardly extending ramp 405 into sorting recess 406, ramp 405 being tapered at an approximate angle of 16° from the horizontal. Sorting recess 406 is largely bounded by an elongated, inwardly spiralling edge 408, rising above land L' to the ceiling of recess 406. Edge 408 terminates at point 650 where it intersects with inwardly directed vertical edges 455 and 456, which bound the outer edge of recess 391. It is noted that an inner portion 457 of edge 456 coincides with opening 358.

Figure 19:
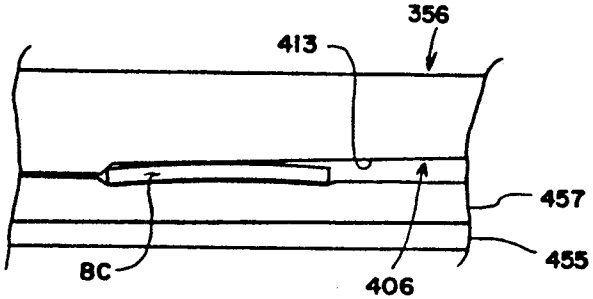
FIG. 19 is a partial sectional view, taken along line 19—19 of FIG. 16, illustrating a feature adapted to accommodate bent, particularly cupped, coins.
Figure 17:
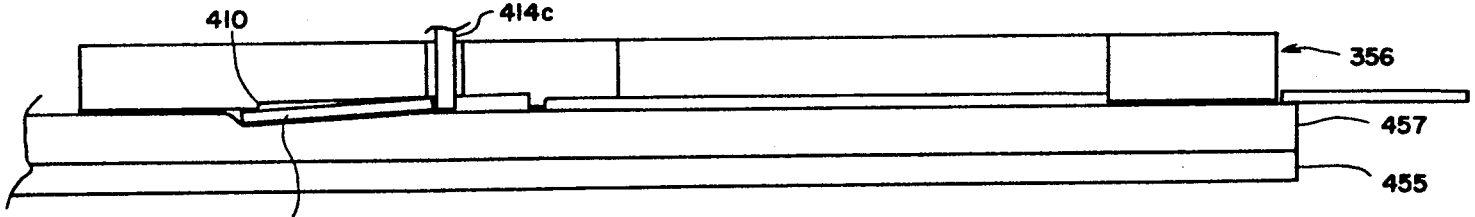
FIG. 17 is a sectional view taken along line 17—17 of FIG. 16.

The ceiling 413 of recess 406 is approximately 0.030" where it intersects edge 410, and, as particularly illustrated in FIG. 17, the height increases at a 2.5° rate toward ramp 405. This taper holds the convex side of a dished or similarly bent coin BC more firmly against the ceiling 413 of recess 406, this being accomplished by increased pad pressure by pad 357 on the coin along its outer edges, resulting from the reduced height of the ceiling of recess 406 along edge 410, as shown in FIG. 19.

Figure 21:
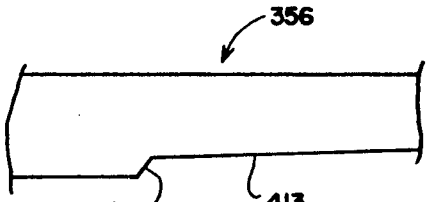
FIG. 21 is a sectional view as seen along lines 21—21 of FIG. 10.
Figure 20:
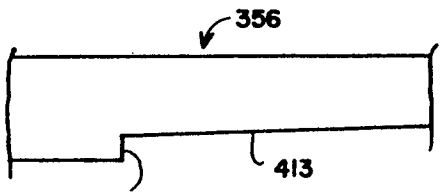
FIG. 20 is a sectional view as seen along line 20—20 of FIG. 10.
Figure 16:
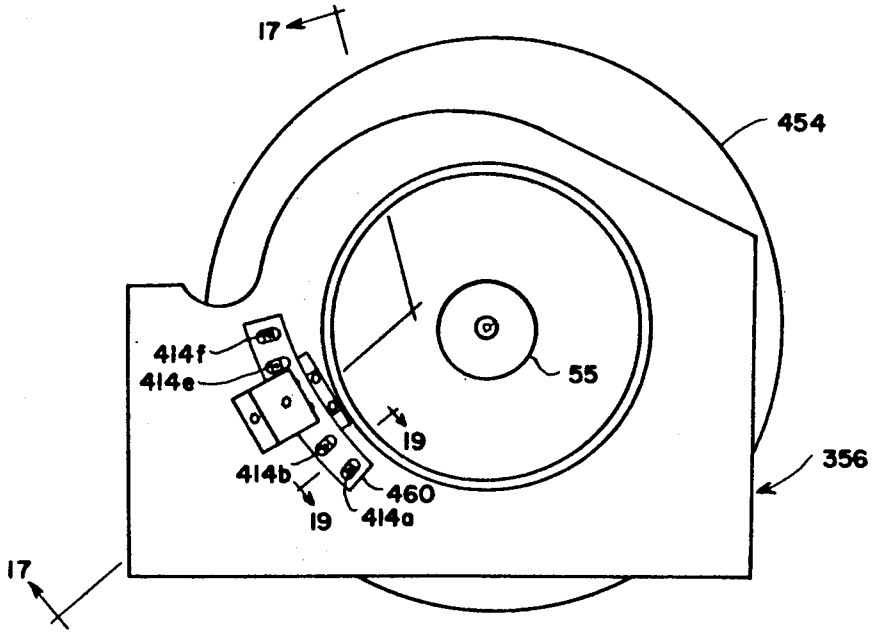
FIG. 16 is a plan view, looking down on a sorter employing the sorting head illustrated in FIG. 10, FIG. 16 thus illustrating the posture in which the sorter is operated.

A first region 407 of edge 408 is vertical, extending to point 409. It is to this region that coins are initially rotated from land L' under ramp 405, and the function of edge portion 407 is to effect a positive redirection along edge 408 counterclockwise toward coin deflection regions 400 without any coins passing under this edge. From point 409 to point 411, edge region 410 of edge 408, as shown in FIG. 21, is tapered at 25° from vertical, whereby the four largest coins are sorted as a function of their diameter by an associated pin of pins 414*a*–414*d*, forcing them under edge region 410 in a manner generally described with respect to FIG. 4. This process is illustrated in FIG. 17 when coin C is forced under edge 410. From point 411, generally counterclockwise, edge region 412 of edge 408 is tapered like edge 410 but at approximately 30° from the vertical to enable the two smallest coins to be more readily forced under edge portion 412 of edge 408, in this case, by sorting pins 414*e* and 414*f*.

Sorting is effected by the combination of the position of pins 414*a*–414*f* and their distance from edge region 410 or 412, this combination being slightly less than diameters of coins to be sorted, with the result that when rotated under one of these edge regions, each coin is captured by land L and rotated in a radius or orbit which is different for each diameter coin, with the result that, as shown, by varying the distance of the center of the rotating pad to the portion of the sorting head from point 453*a* to point 453*f*, edge regions 454*a*–454*f* are created which intersect circular coin movement and thereby points at which coins are released from the sorting head and are thus dispensed. As shown, larger coins are engaged by pins 414*a*–414*f* first and smaller coins last, while larger coins exit from under head 356 first and smaller coins exit last. By manipulating the radial dimensions of the head with respect to the center of the rotating disc from point 453*a* to 453*f*, the position of dispensation of coins may be varied. By initially placing the coins in orbits of selected spacing, which are not directly a function of their diameter but an arbitrary one, sorting and dispensation functions can be combined to enable a much smaller sorter for a given number of coins than previously possible.

The sorting function is halted as described above with respect to the embodiment shown in FIG. 4 by the raising of a pin rack holding pins 414*a*–414*f*. Operation of the pin rack may be as shown in FIG. 5 wherein movement of it is about a pivot provided by spring 130, or, alternately, movement may be effected purely vertically by guides which ensure vertical movement. Bolted-on cone 55 may be made laterally to assist in the prevention of coin stalls.

Figure 18:
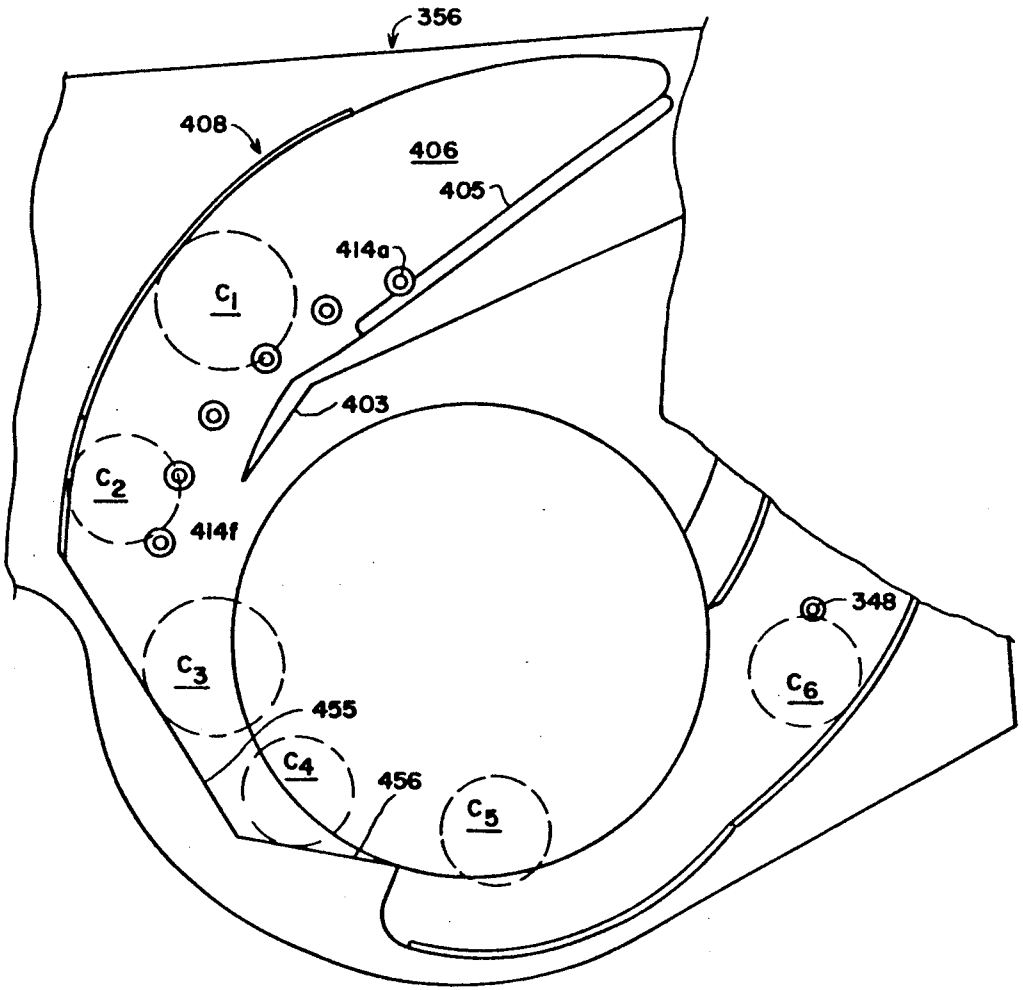
FIG. 18 is a cut-away view of the sorting head shown in FIG. 10, particularly illustrating coin return upon termination of the sorting process.

An opening 347 in channel 380 accommodates a stop pin 348 and its related assembly as illustrated in FIG. 18. When stop pin 348 is lowered, coins are blocked from entering channel 380. Stop pin 348 is operated by a circuit illustrated by, and described with respect to, FIG. 7. Concurrent with the lowering of stop pin 348, sorting pins 414*a*–414*e* are raised, which halts the sorting process as described. In this embodiment, coins between sorting pins 414*a*–414*e* and stop pin 348 when pin 348 is lowered and pins 414*a*–414*e* are raised simply follow edge 408 to inwardly directed edge 455 and edge 456 and are thereafter moved past point 457 back into the central region 358 as illustrated by coins $C_1$–$C_6$ in FIG. 18. Coins, such as coin $C_6$, are rotationally blocked.

At this point in operation, the sorter motor would be turned off in the sequence described above, and significantly, with the stopping of the sorting process, no coins are thereafter dispensed, with the result that no coins beyond those sorted actually leaves the sorter. Thus, it is unnecessary to have an overflow bin or container to catch excess coins.

From the foregoing, it is to be appreciated that the applicants have provided a significantly new and improved coin sorter. It enables a precise dispensation of coins, and at the same time enables the position of dispensation of particular coins to be adjustable independent of the function of sorting.

We claim:

1. In a coin sorter for sorting coins of a multiplicity of diameters having a plate including a side closely facing a rotating, generally planar, resilient disc, said plate having an opening through which coins are loaded onto said disc and defining an interior edge thereof, said plate having an outer edge forming boundaries of said plate, and said side of said plate being configured with lands and recesses which vary in shape and vary in clearance from said disc, the improvement comprising:

one of said lands of said plate having an elongated edge in a region between said edges of said plate, said elongated edge extending through differing radaii and differing angular positions with respect to rotation of a radial line about the center of rotation of said disc, and at least a substantial length of said elongated edge being an inclined edge which is inclined generally toward, and in the direction of, rotation of said disc;

a plurality of coin deflection regions, discrete ones of said regions being differently spaced from said inclined edge as a function of the difference in diameters of coins to be sorted, whereby a coin of a discrete diameter is rotated by said disc and moved to a position where it is engaged between one of said deflection regions and said inclined edge and is thereby urged by said rotating disc across said inclined edge and thereby captured by said one of said lands and at a discrete radial position which differs for coins of different diameters; and said outer edge of said plate having portions varying in distance from the center of rotation of said disc and selectively cooperating with the radius of the paths of rotation of said coins of a multiplicity of diameters;

whereby coins of different diameters are discharged from said sorter at different positions along said outer edge of said plate.

2. A coin sorter as set forth in claim 1 wherein:

said sorter includes adjacent inner and outer recesses, an outer edge of said outer recess guiding coins of one diameter in a first single file, with their outer edges at a first common radius, and an outer edge of said inner recess guiding coins of smaller diameters in a second single file, with their outer edges at a second common radius; and said elongated edge having an end region positioned to intercept coins rotated at different radii from said inner and outer recesses and to guide coins along it to and along said inclined edge.

3. A coin sorter as set forth in claim 1 wherein said coin deflection regions are positioned so that, of a multiplicity of diameters of coins to be sorted, the largest diameter coin is engaged first, and the smallest coin is engaged last.

4. A coin sorter as set forth in claim 3 wherein said elongated edge extends outward and in the direction of rotation of said disc, the smallest diameter coin is discharged first, and the largest diameter coin is discharged last.

5. A coin sorter as set forth in claim 3 wherein said elongated edge extends inward and in the direction of rotation of said disc, the largest diameter coin is discharged first, and the smallest diameter coin is discharged last.

6. A coin sorter as set forth in claim 3 wherein said plurality of coin deflection regions comprises a series of pins, each at a different spacing from said elongated edge, and said pins being positionable adjacent said disc.

7. A coin sorter as set forth in claim 6 further comprising circuit means, in turn including electrical means coupled to each said pin for counting coins engaging said pins.

8. A coin sorter as set forth in claim 7 wherein:

said circuit means includes means for providing a signal responsive to a selected number of a selected diameter of coins having been counted; and said sorter includes pin positioning means responsive to said signal for abruptly increasing the spacing of said pins from said disc, whereby coins would thereafter bypass said pins.

9. A coin sorter as set forth in claim 8 wherein said elongated edge extends inward and in the direction of rotation of said disc, the largest coin is discharged first, and the smallest coin is discharged last.

10. A coin sorter as set forth in claim 8 wherein said elongated edge extends outward in the direction of rotation of said disc, and the smallest coin is discharged first, and the largest coin is discharged last.

* * * * *